United States Patent [19]

Basedow et al.

[11] Patent Number: 4,951,766

[45] Date of Patent: Aug. 28, 1990

[54] ELECTRIC WHEEL-CHAIR

[75] Inventors: Hans Basedow, Kiel; Hans Körber, Kiel; Reinhard Köster, Kiel; Ruth Kruse, Laboe; Dieter Lorenz, Kiel, all of Fed. Rep. of Germany

[73] Assignee: Octopedia GmbH, Kiel, Fed. Rep. of Germany

[21] Appl. No.: 286,522

[22] Filed: Dec. 19, 1988

[30] Foreign Application Priority Data

Jan. 12, 1988 [DE] Fed. Rep. of Germany ..... 3800648
Jan. 22, 1988 [DE] Fed. Rep. of Germany ..... 3801874

[51] Int. Cl.[5] ..... A61G 5/04

[52] U.S. Cl. ..... 180/6.5; 180/6.6; 180/65.1; 180/329; 180/907; 280/304.1

[58] Field of Search ..... 180/907, 329, 330, 6.58, 180/6.6, 65.1, 6.62, 6.28, 6.32, 6.5, 233, 234; 280/304.1, 250.1

[56] References Cited

U.S. PATENT DOCUMENTS 4,351,562 9/1982 Twitchell et al. ..... 180/907
4,513,832 4/1985 Engman ..... 180/907

*Primary Examiner*—David M. Mitchell
*Attorney, Agent, or Firm*—John P. White

[57] ABSTRACT

As a rule, wheel-chairs have large(-diameter) drive wheels (3) and small(-diameter) steerable wheels (5), and wheel-chairs for indoor operation have their drive wheels as their rear wheels, while wheel-chairs for outdoor operation have their drive wheels (3) as front wheels. In the wheel-chair according to the invention, the seat assembly (6) is mounted for rotation about a vertical axis by means of a supporting column (14) above the chassis (1), such that, depending on the purpose of use of the wheel-chair, the large drive wheels are selectively disposed in the front or rear position with respect to the seat(ing) direction. In this way, the wheel-chair may be used both inddors and outdoors in an optimum manner. Additional positioning alernatives of the seat assembly, e.g. at ±90° relative to the chassis, open to the user new possibilities of utilization. By an automatic switchover of the control (or steering) lever in accordance with the position of the seat assembly, optimum operation of the wheel-chair is obtained.

17 Claims, 3 Drawing Sheets

FIG. 3
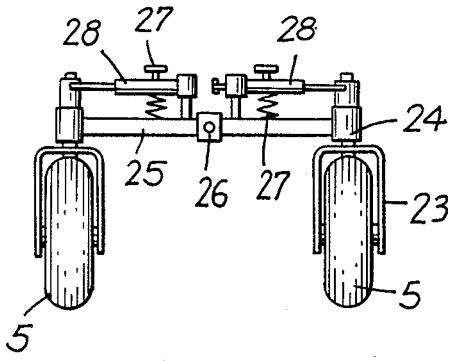
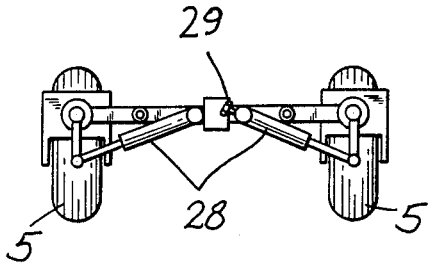
FIG. 4

ELECTRIC WHEEL-CHAIR

The invention relates to an electric wheel-chair, comprising a chassis having larger drive wheels on a first axle or a first pair of axles and smaller (castor) swivel wheels on second axles; a seat assembly mounted on the chassis; one drive unit each for the drive wheels; and an operating unit for controlling the drive units.

Generally, electric wheel-chairs are classified in two categories in accordance with their primary purpose of use, and the chassis is constructed differently depending on the respective purpose of use. In wheel-chairs intended primarily for indoor use (first category), large (or large-diameter) drive wheels are mounted in the rear section and small swivel wheels are provided in the front section of the wheel-chair, while wheel-chairs intended predominantly for outdoor use (second category) have the large drive wheels in the front section and the small swivel wheels in the rear section. Normally, in these two categories the location of the center of gravity of the seat assembly or of the unit comprising seat assembly and chassis is selected differently, too.

In view of the fact, however, that disabled persons who need a wheel-chair are normally living both indoors and outdoors, there are generally needed two wheel-chairs to provide for optimum conditions in each respective application. This is not only very costly, but often also troublesome because of, for example, the frequently necessary changing of wheel-chairs or the storing and transport of two wheel-chairs.

It is the object of the invention to provide an electric wheel-chair of the type as outlined at the beginning, which can be used in an optimum manner for both modes of operation, namely indoors and outdoors, with the conversion from the one mode of operation to the other being possible to be performed easily and in a short time.

According to the invention, this object is solved in that the seat assembly is mounted on the chassis for rotation about a vertical axis of rotation disposed in the central region between the wheel axles, and adapted to be locked in at least two end positions displaced from each other by 180° C., with the seat(ing) direction in each end position extending perpendicular (or normal) to the wheel axles, and the drive wheels serving selectively as front wheels or rear wheels; and that the handling characteristics of the drive units are likewise adapted to be reversed in accordance with the rotation of the seat assembly.

Accordingly, in the electric wheel-chair according to the invention, one single chassis including one single seat assembly is required for either of the indicated modes of operation, while there are nevertheless available the optimum wheel size of the drive and swivel wheels as well as optimum mode of driving for the respective mode of operation. This is made possible in that by means of a relative rotation of seat assembly and chassis the respective front and rear wheels are exchanged with each other, and the handling characteristics are also switched over correspondingly.

The rotatable mounting of the seat assembly on the chassis provides further advantages. For example, in addition to the two above-mentioned end positions for opposite directions of travel, it is also possible to set further intermediate positions of the seat assembly, such as in an angular position of 90° to the longitudinal direction of the chassis. In this manner, a disabled person may be positioned, for specific purposes, in a more favorable or comfortable position transversely of the direction of travel, such as for getting in or out from the wheel-chair of for certain treatments, for example. Naturally, other intermediate positions at any desired angles may be set too, if necessary. In addition, the design may be made so that the seat assembly is adapted to be adjusted vertically relative to the chassis.

In order to render possible rotation of the seat assembly relative to the chassis, the chassis may include, for example, a vertical supporting column for the seat assembly, which column is centrally positioned between the wheels and in which a rod-shaped trunnion for the seat assembly is mounted (for rotation). In this structure, there may be provided a locking device which locks the chassis and the seat assembly to each other in the respective angular positions desired. To this end, there may be provided, for example, receiving holes, formed on the chassis on a circle around the axis of rotation, for a locking pin adjustably or movably arranged on the seat assembly. This locking pin may be biased by spring force towards the receiving hole so as to engage (a hole) when reaching a respective locking position. Naturally, the movable part, in the form of a locking pin or in any desired other form, may be provided also on the chassis, while the receiving means therefore may be provided in the rotatable seat assembly. In general, however, it is more favorable to connect the movable locking member with the seat assembly, so that this member is always in the same position for operation by a person occupying the seat assembly, regardless of the respective angular position.

Preferably, the seat assembly rotatably mounted on the chassis is adapted to be readily removed from the chassis, so as to be replaceable. In this way, different special constructions of seat assemblies may be readily exchanged with each other as desired. In view of the fact that, further, it is beneficial in some instances that the center of gravity of the seat assembly is not located exactly in the center position between the wheel axes, since different centers of gravity with respect to the wheel axes may be desirable depending on the mode of operation indoors or outdoors, it is provided according to an expedient further embodiment that the seat assembly is also adjustable in the horizontal direction relative to the axis of rotation. To this end, there may be provided sliding guide means on which the seat assembly is movable and adapted to be locked in the respective position desired.

Normally, rotation and even the above-mentioned horizontal adjustment or movement of the seat assembly are performed manually. However, it is also conceivable to provide a respective servo motor for these rotating or sliding movements. Also, switchover of the drive unit may be performed manually by means of a switch, which switch is expediently located in the region of the operating instrument.

Particularly easy, however, is an automatic switchover operation by means of sensors disposed in the junction region between the chassis and the seat assembly, which sensors act to automatically detect the relative position between chassis and seat assembly.

Further beneficial embodiments and further developments are disclosed in the subclaims.

Below, the invention is explained in exemplary embodiments with reference to the drawing, wherein:

FIG. 3 is a schematic front elevational view of the steerable wheel assembly;

FIG. 4 is a schematic plan view of the steerable wheel assembly; and

Figure 1:
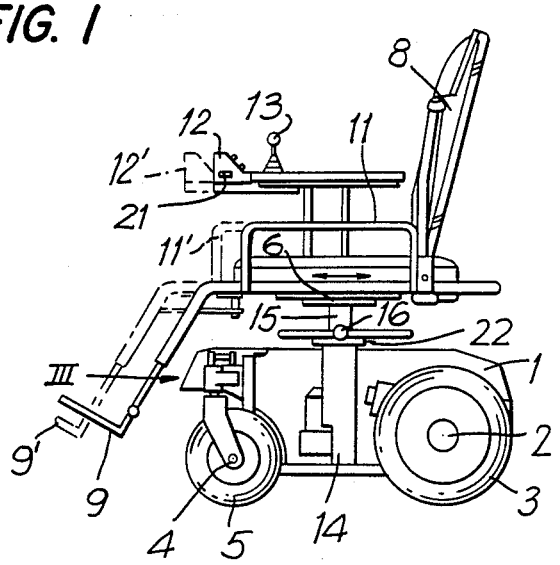
FIG. 1 is a side elevational view of an electric wheel-chair embodied in accordance with the invention.

The electric wheel-chair shown in FIG. 1 comprises a chassis 1 having four wheel axles. The first two wheel axles 2 mount relatively large (large-diameter) drive wheels 3, while a pair of swivel wheels 5 of a small diameter compared to the drive wheels, are mounted on a third and fourth axle 4 each.

The large wheels are used for driving purposes, while the small wheels are used for steering. The suspension of the small wheels, i.e. the steerable or swivel wheels, will be explained below.

A seat assembly 6 is mounted on the chassis 1 substantially centrally between the wheel axles. This seat assembly comprises, in a manner known per se, a seat member 7, a back rest 8 and a foot rest 9 which may be adjustable, for example, and which, in the example shown, includes a pair of separate rests for each foot (see FIG. 2). Further, the seat assembly has mounted on the sides thereof respective arm rests 11, with the right-hand arm rest being provided with an operating unit 12 including a control (or steering) lever 13. In these regards, the structure of the seat assembly corresponds to conventional constructions.

In the position of the seat assembly 6 above the chassis 1 as shown in FIG. 1, a wheel-chair for indoor use is illustrated, because the large drive wheels are mounted on the rear end of the chassis in correspondence with the seat(ing) position, and the swivel wheels are mounted on the front end. For outdoor use of the wheel-chair, however, it is more favorable to position the drive wheels on the front side and the movable swivel wheels on the rear side, because it is easier in this manner to travel across irregularities and small obstacles. Now, in order that the wheel-chair shown in FIG. 1 can be used also outdoors (outside the house), the seat assembly 6 is rotatably or pivotally mounted on the chassis 1. To this end, the chassis includes a supporting column 14 on which the seat assembly 6 is mounted by means of a single rod-shaped trunnion 15 having a vertical axis of rotation. Accordingly, the seat assembly may be rotated from the position shown in FIG. 1 by 180° relative to the chassis, such that the seat then is directed to the right-hand side in FIG. 1, and thus the drive wheels 3 are located on the front side with respect to the seat direction, while the swivel wheels 5 are on the rear side of the chassis. The operating unit 12 is fixedly coupled to the seat assembly so that it can be reached and operated in always the same way by the disabled person seating in the wheel-chair. In the respective travel position, the seat assembly 6 is locked relative to the chassis 1 by means of a locking device 16.

Figure 2:
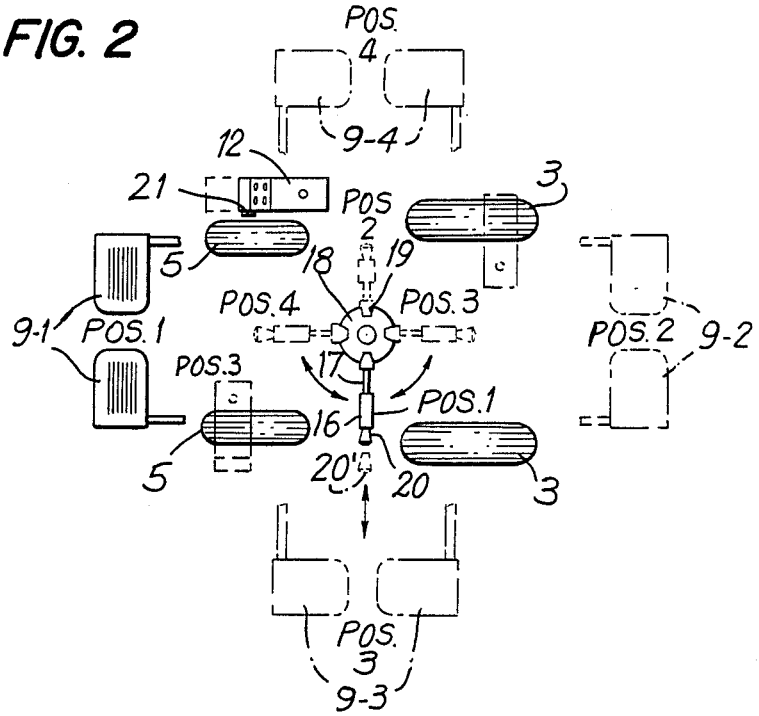
FIG. 2 is a plan view showing the four wheels of the wheel-chair and diagrammatically illustrating four different positions of the seat assembly.

FIG. 2 shows schematically above the two pairs of wheels 3 and 5 according to FIG. 1, illustrated in plan view, various seat positions that can be obtained. Illustrated in FIG. 2 are only the foot rests 9 which indicate the seat(ing) direction by their position relative to the wheels. Shown as position 1 is the orientation according to FIG. 1 in which the foot rests 9 are located on the left-hand side of the drawing in front of the small swivel wheels 5; the foot rests are denoted 9-1 to identify position 1. Illustrated in the center between the four wheels is an example for a possible design of the locking device 16. This locking device 16 is mounted to the seat assembly and includes a locking pin 17 which is movable in the direction perpendicular (or normal) to the axis of the supporting column 14, and which is biased in this direction towards the supporting column 14. Connected with the supporting column 14 is a locking disc or plate 18 which includes for each selectible seat position a receiving member 19 for the tip end of the locking pin 17. When the seat assembly is to be rotated from the position shown in FIG. 1, the locking pin 17, illustrated in FIG. 2, is retracted (position 20') by means of a handle 20, whereby the seat assembly 6 is unlocked from the supporting column. For reversing the direction of travel, the seat assembly is then rotated by 180° to position 2, whereby the foot rests assume the orientation (position) 9-2 according to FIG. 2. The locking pin is (slidably) mounted on the seat group, and after the above-described rotation the locking pin likewise assumes a position rotated by 180°, which position is not shown in FIG. 2. Then, the locking pin 17 engages (snaps into) the receiving member 19 under its bias (from above in the drawing).

As the seat assembly 6 is mounted (for rotation) through a trunnion 15 on a supporting column 14 of the chassis 1, it is also possible to easily replace or exchange the seat assembly such that, depending on the kind and degree of handicap of a person, different chassises may be combined in an easy manner with seat assemblies of different designs. In this manner, different handling characteristics can be provided by the different chassises. However, the rotatable mounting of the seat assembly also permits to set, without extra expenditure, not only two seat positions to the front and rear of the travel direction; rather, additional intermediate positions may be set, too. For example, it is possible to lock the seat assembly in an angular position of about 90° relative to the travel direction, whereby the disabled person seating in the wheel-chair can assume, for certain purposes, a more favorable or comfortable position transversely of the rolling direction of the wheels. Such positions are shown in FIG. 2 as positions 3 and 4, respectively, as indicated by the schematically illustrated foot rests 9-3 and 9-4, respectively. Locking in these additional positions is effected in the same manner as described above for the two primary seat positions. Naturally, it would be conceivable to define in case of need further additional angular positions, and to correspondingly form the locking device.

With a rotation of the seat assembly by 180°, it is also necessary to correspondingly modify the control or driving of the drive wheels since the changed directions of rotation for forward and reverse travel and the changed driving (handling) conditions in the steering system must be considered with respect to the drive wheels which are now in the front position. A further modification is necessary when the seat direction is rotated by 90° relative to the travel direction of the drive wheels. The electrical switchover of the drive units, which is required in this instance, can be effected by, for example, actuating a switch 21 in the operating unit. Alternatively, it is possible to effect automatic switchover, with the signal for each required setting of the drive units being produced by sensor means 22 which is positioned in the junction region between the chassis and the seat assembly, and which responds to relative movement between the seat assembly on the one hand, and the chassis on the other hand. Two sensor elements are required for the binary scanning of four potential positions of the seat assembly. For eight positions, three sensors would be required, i.e. $2^n$ sensors each, with n being the number of possible positions. As sensor elements, there may be considered a variety of conventional components, such as microswitches, Hall elements, optoelectronic elements, inductive or capacitive proximity switches, etc. In the case of a greater number of positions that can be chosen, it is also possible to use incremental angle transmitters (or sensors) of a conventional design, the output values of which may be evaluated electronically in order to provide for smooth transitions between the various seat positions.

Figure 5:
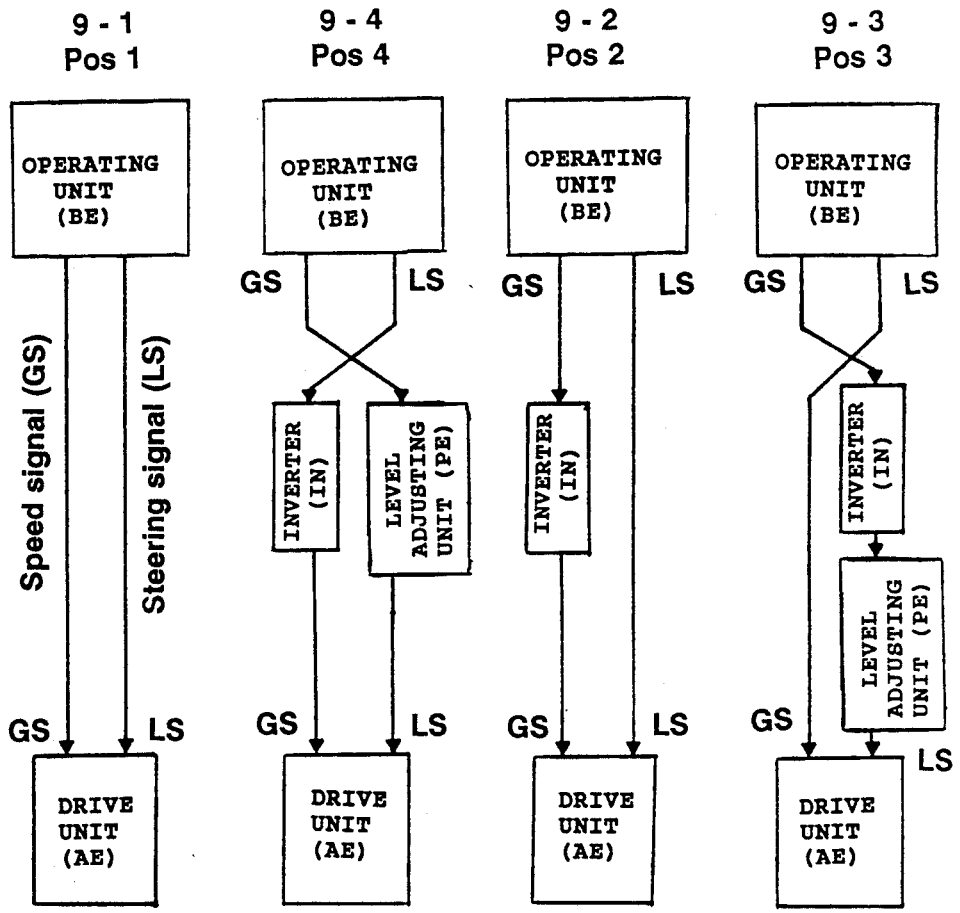
FIG. 5 is a diagram illustrating the interlinking of the speed and steering signals for the various positions shown in FIG. 2.

In the embodiment described above, four possible or potential seat assembly positions were assumed, such that, thus, the seat assembly takes a position of 0°±90° or 180° relative to the travel direction of the drive wheels. A scheme for automatic correlation of the speed and steering signals from the operating unit to the drive units is shown in FIG. 5. This Figure indicates for each of the positions of the foot rests as shown in FIG. 2 (corresponding to the direction of the seat assembly) the respective conversion of the signals provided by the operating unit.

For position 9-1 (0° position), the speed signal (GS) from the operating unit is supplied to the drive units without any variation, same as the steering signal indicating a desired change of direction.

In position 9-4 corresponding to a rotation of the seat assembly by 90° to the right, the speed signal (GS) is converted into a steering signal (LS) for the drive units (AE), whereby the amplitude is reduced through a level adjusting unit (PE). This means that, for example, forward movement of the control (or steering) lever in the operating unit for the drive wheels, is converted into a steering signal to the right (forward or reverse, depending on the additionally fed speed signal). Simultaneously, the steering signal (LS) generated by the operating unit from pivoting of the control lever to the left or right is converted into a speed signal (GS) for forward or reverse drive of the drive wheels. Furthermore, this signal is inverted through an inverter (IN), such that a right-hand steering signal results in reverse rotation, and a left-hand steering signal results in forward rotation of the drive wheels 3.

In position 9-2 of the foot rests, the seat position is rotated by 180°. In this instance, if suffices to invert only the speed signal (GS) by an inverter (IN), whereas the steering signal is transmitted as such to the drive units.

In position 9-3 of the foot rests, corresponding to rotation of the seat assembly by 90° to the left from the original position, the steering signal (LS) for the drive units, again, is converted into a speed signal, but without being inverted. On the other hand, the speed signal (GS) is converted by an inverter (IN), and additionally by a level adjusting unit (PE), into a steering signal (LS) for the drive units (AE). In this instance, the handling characteristics are adjusted or conformed in a corresponding manner.

If further intermediate positions for the seat assembly are provided, the automatic quadrant matching (or control) of the operating unit also must be refined correspondingly.

If in special instances the center of gravity of the seat assembly and of the person occupying the seat assembly must be shifted from the central region, namely with e.g. an extreme adjustment of the seat depth or an extreme inclination of the back rest, a corresponding adjustment of center of gravity can be effected even in the rotatable seat assembly for either direction of travel. To this end, in the example of FIG. 1 there is provided sliding guide means in the seat assembly, which allows for horizontal movement of the entire seat assembly relative to the trunnion 15. Some portions of the seat assembly are indicated in FIG. 1 in their shifted position, such as an arm rest 11', a foot rest 9' and the shifted operating unit 12'. The sliding guide means as such is not shown in detail, as guide members of this type are familiar to the expert.

In order to ensure optimum handling characteristics for every application of the electric wheel-chair both indoors and outdoors, the swivel wheels 5 are suspended in a special manner. The two swivel wheels 5 are each mounted for free swivelling through wheel forks 23 on vertical axes 24, and suspended from a balance beam system for conforming themselves to different ground conditions. The balance beam 25 is pivotally mounted on a horizontal pivot shaft 26 and damped relative to the chassis through spring members 27. In this way, irregularities of ground can be properly absorbed, particularly in outdoor operation.

In order to further keep stable the given direction of travel in either application (indoors and outdoors), there are additionally provided pneumatic-hydraulic damper members 28 which can selectively be set to be fixed or adjusted by means of a setting screw 29. This measure improves the directional stability of the freely pivotable swivel wheels particularly at a high speed of travel. FIG. 4 illustrates in schematical plan view such steering dampers 28. It can be seen from this schematical view that the steering dampers (or shock absorbers) are disposed at an angle to the axis of the balance beam 25.

Incidentally, it may be noted that in the embodiment shown the swivel wheels are mounted for free pivoting or rotating movement; this means that change of direction of the wheel-chair is brought about by different speeds of rotation of the two drive wheels. In this case, the swivel wheels turn automatically to the desired direction.

We claim:

1. An electric wheel-chair comprising:

a chassis;

at least one first axle having drive wheels, which is connected to the chassis;

a pair of second axles which are connected to the chassis, each having a swivel wheel;

a seat assembly rotatively mounted on the chassis between the first and second axles, having an axis of rotation, the seat assembly having at least two lockable seating positions, including first and second end positions oriented 180° from each other and normal to rotational axes of the axles;

a drive unit coupled to each drive wheel for driving that wheel in response to control signals that are routed to assigned signal receipt locations in the drive unit, which control signals are indicative of desired wheel-chair maneuvers to be executed by the drive unit with respect to one of the seating positions;

an operating unit coupled to the drive units for generating the control signals; and means coupled to the operating unit and the drive units for rerouting the control signals from the operating unit to the drive unit signal receipt locations, so that the drive units execute the same desired wheel-chair maneuvers when the seat is positioned in at least said first and second end positions.

2. The wheel-chair of claim 1, wherein the means for rerouting control signals is at least one switch that is actuated by seat rotation to another seating position.

3. The wheel-chair of claim 1, wherein the means for rerouting control signals has at least one sensor which generates a sensor signal indicative of the seat position and the means for rerouting control signals performs the rerouting in response to the sensor signal.

4. The wheel-chair of any one of claims 1–3, wherein the seat assembly is lockable in at least one position intermediate the end positions.

5. The wheel-chair of claim 4, wherein the seat assembly is lockable in an angular position of 90° relative to the two end positions.

6. The wheel-chair of any one of claims 1–3, wherein the seat assembly has means for vertical adjustment relative to the chassis.

7. The wheel-chair of any one claims 1–3, wherein the chassis has a vertical supporting column positioned between the drive and swivel wheels; the seat assembly has a rod-shaped trunnion for insertion into the vertical supporting column and the trunnion is rotatable within the vertical supporting column.

8. The wheel-chair of any one of claims 1–3, wherein the seat assembly has a locking pin for locking a chosen seat position and the chassis has means for receiving the locking pin at each seat locking position.

9. The wheel-chair of any one of claims 1–3, wherein the seat assembly and chassis have supports for preventing horizontal movement of the seat assembly relative to the seat rotational axis.

10. The wheel-chair of claim 9, further comprising sliding guides coupling the seat to the chassis for slidable movement of the seat relative to the chassis and a slide lock for locking the seat in a desired slide position.

11. The wheel-chair of any one of claims 1–3, wherein the operating unit has a circuit for electrically reversing control signal routing to the drive unit signal receipt locations.

12. The wheel-chair of any one of claims 1–3, wherein the swivel wheels are connected to the chassis through a shock-absorbing balance beam suspension system.

13. The wheel-chair of any one of claims 1–3, further comprising steering dampers coupling the swivel wheels to the chassis for directionally stabilizing the wheel-chair.

14. The wheel-chair of claim 13, wherein at least one of the swivel wheel steering dampers has means for fixing or adjusting the amount of damping.

15. The wheel-chair of claim 3, wherein the operating unit generates forward and reverse drive directional signals relative to one of the end seating positions and the means for rerouting the control signals inverts routing of the directional signals to the drive unit signal receipt locations when the seat assembly is rotated to the second end seating position.

16. The wheel-chair of claim 3, wherein:

the seat assembly has a seating position oriented 90° relative to the first and second end seating positions;

the operating unit generates left/right steering signals and forward/reverse sped signals which are routed to the drive unit control signal receipt locations for effecting desired wheel-chair motion relative to one of the end seating positions; and when the seat is rotated to the 90° seating position, the means for rerouting the control signals reroutes the left/right steering signals generated by the control unit to the first seating position forward-/reverse speed signal receipt locations in the drive unit and reroutes the forward/reverse control signals generated by the control unit to the left/right steering signal receipt locations in the drive unit.

17. The wheel-chair of claim 16, wherein the means for rerouting the control signals reduces the amplitude of the forward/reverse control signal before rerouting that signal to the drive unit left/right steering signal receipt locations.

* * * * *

UNITED STATES PATENT AND TRADEMARK OFFICE

CERTIFICATE OF CORRECTION

PATENT NO. : 4,951,766

DATED : August 28, 1990

INVENTOR(S) : Hans Basedow, Hans Körber, Reinhard Köster, Ruth Kruse and Dieter Lorenz It is certified that error appears in the above-identified patent and that said Letters Patent is hereby corrected as shown below:

On the cover page of the patent, in block [73] the Assignee should read --Ortopedia GmbH--

Signed and Sealed this

Seventh Day of January, 1992

*Attest:*

*Attesting Officer*

HARRY F. MANBECK, JR.

*Commissioner of Patents and Trademarks*